United States Patent [19]

Koyama et al.

[11] Patent Number: 4,656,861

[45] Date of Patent: Apr. 14, 1987

[54] BENDING MACHINE AND A DIE CHANGING SYSTEM FOR SUCH BENDING MACHINE

[75] Inventors: Shigeo Koyama, Hatano; Katsuyoshi Sakamoto, Isehara, both of Japan

[73] Assignee: Amada Company, Limited, Japan

[21] Appl. No.: 823,461

[22] Filed: Jan. 28, 1986

Related U.S. Application Data

[62] Division of Ser. No. 717,675, Mar. 29, 1985.

[30] Foreign Application Priority Data

Mar. 30, 1984 [JP] Japan ..... 59-060887
Apr. 5, 1984 [JP] Japan ..... 59-049140

[51] Int. Cl.[4] ..... B21D 5/04

[52] U.S. Cl. ..... 72/323; 72/316; 72/446; 29/568

[58] Field of Search ..... 72/316, 319–323, 72/446, 448, 442, 444; 29/568; 83/563, 549

[56] References Cited

U.S. PATENT DOCUMENTS 3,591,920 7/1971 Brainard et al. ..... 29/568
3,719,987 3/1973 Seidel ..... 29/568
3,744,648 7/1973 Kuhnert ..... 29/568
4,188,815 2/1980 Mizushima ..... 29/568
4,190,947 3/1980 Sato et al. ..... 29/568

FOREIGN PATENT DOCUMENTS 39034 3/1982 Japan ..... 72/446
1193068 5/1970 United Kingdom ..... 29/568

*Primary Examiner*—Daniel C. Crane
*Attorney, Agent, or Firm*—Wigman & Cohen

[57] ABSTRACT

The present invention relates to a bending machine having a bottom die on which a sheet metal workpiece is supported horizontally in a frame body and an upper die which secures the workpiece by pressing against the bottom die. A bending beam is freely movable in the vertical direction to bend the edges of the workpiece when the workpiece is secured between the top and bottom dies. The bending machine also comprises a die changing system having a plurality of elevator bases each formed with a plurality of stages which store top dies separately and a device for controlling the elevator bases individually to prepare any combination of the top dies stord on the stages and a die exchanging device for furnishing the combination of the top dies in the proper position in the bending machine by transferring it from the stages.

7 Claims, 9 Drawing Figures

BENDING MACHINE AND A DIE CHANGING SYSTEM FOR SUCH BENDING MACHINE

This is a divisional of co-pending application Ser. No. 717,675, filed on Mar. 29, 1985.

BACKGROUND OF THE INVENTION

1. Field of the Invention

The present invention relates generally to a device which bends a sheet metal workpiece, and to a system for changing the die on that device, and, more particularly, to a device which maintains a sheet metal workpiece in a horizontal plane so that it is capable of being conveyed, for example, in a horizontal line, and which bends the edge of that workpiece in, for example, an L-shape, and to a die exchange system for such a bending machine which is capable of quickly changing a die made up of separate sections assembled to a length conforming to the width of the workpiece.

2. Description of the Prior Art

As an example of a device which holds a workpiece horizontally and bends an edge of that workpiece into an L-shape, a tangent bender, for example, is commonly known. The tangent bender is provided with a bottom die which supports the workpiece from the bottom, and a top die freely movable in the vertical direction which presses the workpiece from the top against the bottom die. It is also provided with a freely rotatable bend-beam which bends the edge of the workpiece upward, while that workpiece is secured by the application of pressure between the bottom die and top die. Generally, the bend-beam on the tangent bender is supported in a freely rotatable manner at both ends only, so when the workpiece is being bent there is a tendency for an inflection to occur near the center of the bend-beam from the drag of the workpiece, making it difficult to carry out the bending operation with a satisfactory degree of precision. Accordingly, to suppress this inflection, the width of the bend-beam is made larger near its center.

As outlined above, because the bend beam on a conventional tangent bender is comparatively wide near its center, if the workpiece is conveyed, when the tangent bender is positioned in the process line where the bending operation is carried out, the wide part of the bend-beam hinder in positioning on the transportation roller. This is not suitable for a process line where the object is a workpiece of comparatively small width. Also, in a process where one edge of a plate-shaped workpiece and then the other edge is to be bent continuously, when a pair of tandem benders are positioned opposingly with the process line in the center, it is necessary to separate the bender beams on these tandem benders a comparatively large distance to prevent interference, which is not a desirable situation.

In addition, the top die in a tangent bender is installed on the bottom of a ram which is capable of moving freely in the vertical direction, which is intended to conform to sheet metal workpieces of diverse widths, and which, generally, is formed of a divided die assembled in freely diverse lengths. Specifically, this top die is formed of a plurality of divided leaves appropriately combined in diverse lengths. In changing this top die to conform to the width of the workpiece, a die-changing robot, for example, is used, and each split leaf can be mounted or dismounted on the ram. Accordingly, a considerable amount of time is used in dismounting and mounting this top die on the ram when making a change, making it difficult to improve operating efficiency.

SUMMARY OF THE INVENTION

A first object of the present invention is to provide, with due consideration to the drawbacks of such conventional devices, a bending machine which can be equipped with a narrow-width bend-beam to bend the edge of a sheet metal workpiece secured to the top of a bottom die by a top die.

A second objective of the present invention is to provide a bending machine which is able to simultaneously bend edges of a sheet metal workpiece.

A third object of the present invention is to provide a bending machine which is capable of bending the edge of a workpiece at an optional angle.

A fourth object of the present invention is to provide a bending machine which is capable of easily adjusting the clearance between the top die and bend-beam to conform to the plate thickness of the workpiece.

A fifth object of the present invention is to provide a die changing system which allows easy changing of the top die on the bending machine, where the top die can be assembled in optional lengths.

A sixth object of the present invention is to provide a die changing system which allows simultaneous changing of the top die on the ram where the top die is provided in parallel on the bending machine.

Briefly described, these and other objects of the present invention are accomplished by the provision of a bend-beam which is constructed in such a way as to bend the edge of a sheet metal workpiece upward from the bottom, while the sheet metal workpiece is secured by being pressed between a bottom die and a top die. This bend-beam is also constructed so that its upper position and the distance between the bend-beam and the top die are freely adjustable. In addition, this bending machine is constructed symmetrically, with pair of the bottom dies, top dies, and bend-beams being positioned in parallel.

Also, a storage section, which stores a plurality of top dies divided into diverse lengths, is provided with a plurality of rows and stages. Because the plurality of diverse rows of the storage section are optionally assembled, the top die can be assembled in appropriate optional lengths. A configuration linking a plurality of die-changing mechanism allows them to be used simulteneously.

BRIEF DESCRIPTION OF THE DRAWINGS

These and other objects, features and advantages of the present invention will become more apparent from the following description of a preferred embodiment taken in conjunction with the accompanying drawings, in which.

DESCRIPTION OF THE PREFERRED EMBODIMENTS

Following is a description of the preferred embodiments of the present invention, with reference to the drawings.

Figure 1:
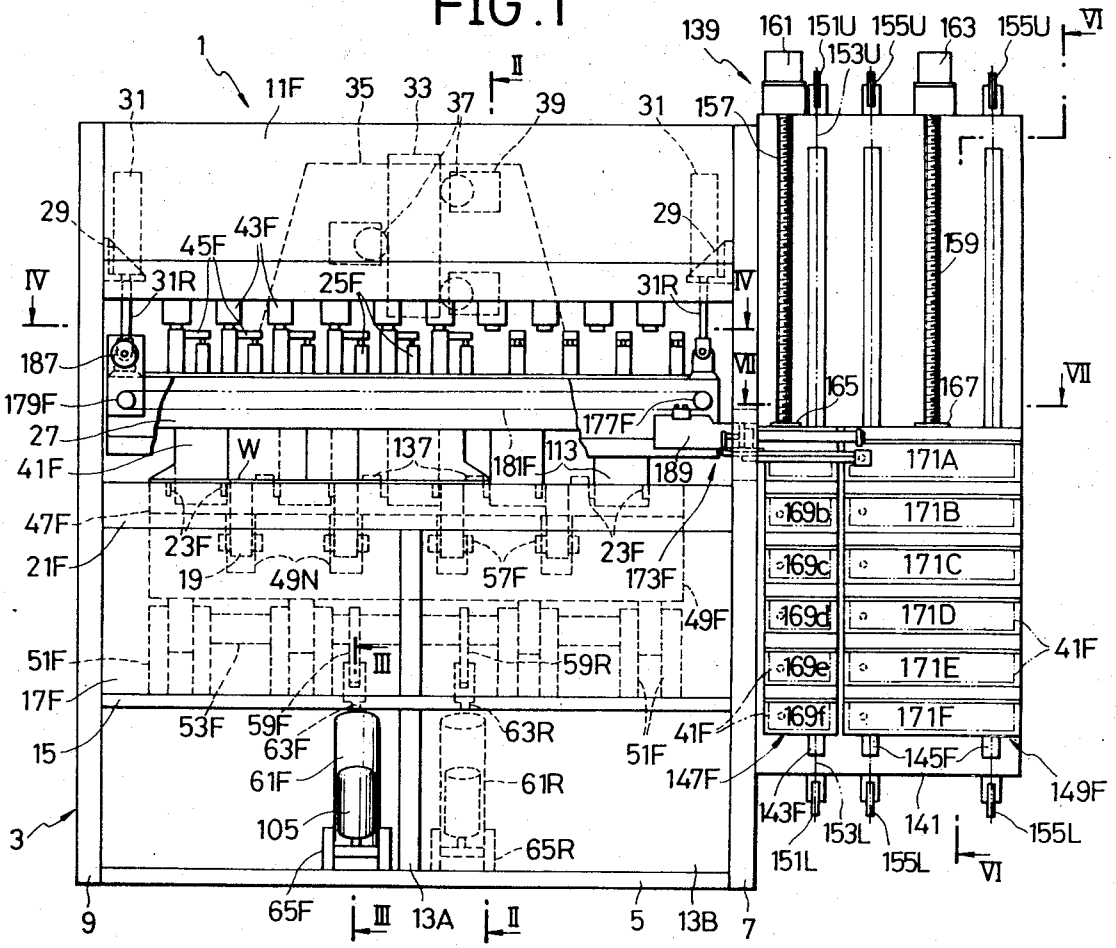
FIG. 1 is a front elevation of an embodiment of the bending machine of the present invention.
Figure 2:
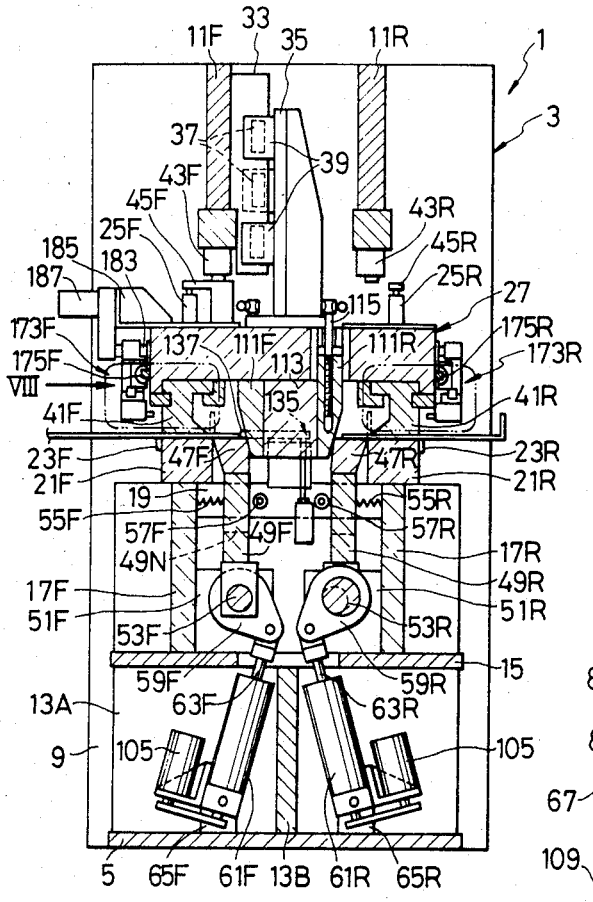
FIG. 2 is a sectional view taken along the line II—II in FIG. 1.

Referring now to FIG. 1 and FIG. 2, a bending machine 1, for bending the edge of a sheet metal workpiece W, is illustrated. A frame body 3, on which the bending machine 1 is constructed, comprises a base 5, a left side frame 7 and a right side frame 9, which are erected on the base 5 to form the both sides of the frame body 3, and a plurality of upper beam members 11F and 11R, which are supported on the side frames 7 and 9 at the left and right edges and separated from front to rear.

Close to the center sections in respect to both the left and right and front and rear directions of the base 5, support plates 13A and 13B are erected respectively, and both edges of the support plate 13B, which is extended in the left and right directions, are connected to the side frames 7 and 9. A horizontal plate 15, connected to both the left and right edges of the side frames 7 and 9, is supported on the upper section of both these support plates 13A and 13B. A plurality of die support plates 17F and 17R, of which the left and right edges are connected to the side frames 7 and 9, are erected on the upper surface of the horizontal plate 15 with a suitable distance between them from front to rear. The front and rear die support plates 17F and 17R are mutually connected by means of a plurality of connecting members 19 which are elongated in the front and rear directions. A plurality of front and rear bottom dies 21F and 21R, of which both edges are connected to the side frames 7 and 9, are respectively supported on the upper sections of the connecting members 19.

These bottom dies 21F and 21R support the workpiece W. On their respective suitable surfaces, front and rear, a plurality of suitable sensors 23F and 23R such as, for example, limit switches or proximity switches for detecting the width of the workpiece W, are mounted at suitable intervals. The sensors 23F and 23R are installed to conform to a plurality of rotary activators 25F and 25R, which will subsequently be explained. The sensors 23F and 23R, by detecting the presence or absence of the workpiece W, act to control the actions of the conforming rotary actuators 25F and 25R.

In addition, as can be understood from FIG. 1 and FIG. 2, in the upper position of the bottom dies 21F and 21R, a ram 27 is positioned so that it may move freely in the vertical direction. The front and rear width of the ram 27 is a larger distance than the front and rear distance of the bottom dies 21F and 21R, and is extended a larger distance in the left and right direction. Both sides of the ram 27 in the left and right directions are rotatably connected to a piston rod 31R of an elevating cylinder 31 mounted through a bracket 29 on the inside surfaces of the side frames 7 and 9. Accordingly, the ram 27 is caused to move in the vertical direction by the action of the elevating cylinder 31.

Superpositioned on the ram 27 to guide it, a guide block 33 is mounted superpositionedly on the center section of the rear surface of the upper beam member 11F. A trapezoid-shaped guide bracket 35 is vertically mounted on the central upper surface of the ram 27. A plurality of roller brackets 39, which provide for the free rotation of a guide roller 37 which moves in a freely rolling manner on the superpositioned surface of the guide block 33, are mounted on the guide bracket 35. Accordingly, the ram 27 is guided in the side block 33, and moves superpositionedly in the vertical direction.

In the front and rear sections of the bottom surface of the ram 27, as previously outlined, the top dies 41F and 41R, which secure the workpiece W by pressing it against the bottom dies 21F and 21R, are respectively installed in a freely dismountable manner. These top dies 41F and 41R are made up of a plurality of split leaves of appropriate dimensions divided into a large number of parts which are assembled and used in appropriate lengths to conform to the width of the workpiece W. A plurality of pressure cylinders 43F and 43R, which are used for applying pressure to the ram 27 when the workpiece W is pressed against the bottom die 21F and 21R by the top dies 41F and 41R, is installed so that the pressure cylinders 43F and 43R are spaced at suitable intervals on the bottom surfaces of the upper beam members 11F and 11R. On the upper surface of the ram 27, the rotary actuators 25F and 25R are mounted to conform to each of the pressure cylinders 43F and 43R. On the rotational axis of each of the rotary actuators 25F and 25R a plurality of L-shaped movable blocks 45F and 45R is mounted so that the blocks 45F and 45R can freely move to a position directly under the pressure cylinders 43F and 43R and a position separated from the position directly under the pressure cylinders 43F and 43R.

As a result of this construction, only the equivalent rotary actuators 25F and 25R act according to the action of the sensors 23F and 23R which have detected the workpiece W. Accordingly, only some members of the movable blocks 45F or 45R which conform to the position of the workpiece W is positioned directly under the pressure cylinders 43F and 43R. Only the part of the ram 27 which corresponds to the workpiece W is pressed down by the pressure cylinders 43F and 43R.

Accordingly, even in the case where there is uneven distribution on one side of the workpiece W, the workpiece W can be pressed uniformly, and a uniform bending is carried out, further improving the precision of the operation.

In order to bend upward the edge of the workpiece W, which is secured by the pressure of the top dies 41F and 41R against the bottom dies 21 and 21, a plurality of bend-beams 47F and 47R are provided on the inner sides of the bottom dies 21F and 21R so that they can move freely in the vertical direction. More specifically, the bend-beams 47F and 47R are mounted on the upper portion of a plurality of bending rams 49F and 49R which are installed so that they have unrestricted vertical movement. On the lower portion of each of the bending rams 49F and 49R, a plurality of eccentric shafts 53F and 53R, which are supported in a freely rotatable manner on the horizontal plate 15, are matingly supported at their eccentric section through a plurality of brackets 51F and 51R. Accordingly, the eccentric shafts 53F and 53R rotate in a suitable manner, causing the bending rams 49F and 49R to be elevated. It will now be understood that by the elevation of the bending beams 47F and 47R beyond the upper surfaces of the bottom dies 21F and 21R, the edge of the workpiece W, which is pressed against the bottom dies 21F and 21R by the top dies 41F and 41R, will be bent in the upward direction.

These bending rams 49F and 49R, are forced in the inner direction by means of suitable metal springs 55F and 55R, such as coil springs, mounted elastically between the die support plates 17F and 17R. However, a large inclination to the inner direction of the bending rams 49F and 49R is regulated by a plurality of regulating members 57F and 57R provided on the connecting member 19 which is fitted so that it pierces a cut-out section 49N in the bending rams 49F and 49R.

A plurality of arm members 59F and 59R are integrally and respectively mounted on the eccentric shafts 53F and 53R to rotate these eccentric shafts 53F and 53R. The leading sections of a plurality of piston rods 63F and 63R of a plurality of bending cylinders 61F and 61R are pivotally connected to and supported on the leading section of these arm members 59F and 59R. Accordingly, it will now be understood that the eccentric shafts 53F and 53R are caused to rotate by means of the reciprocating action of the piston rods 63F and 63R of the bending cylinders 61F and 61R.

Figure 3:
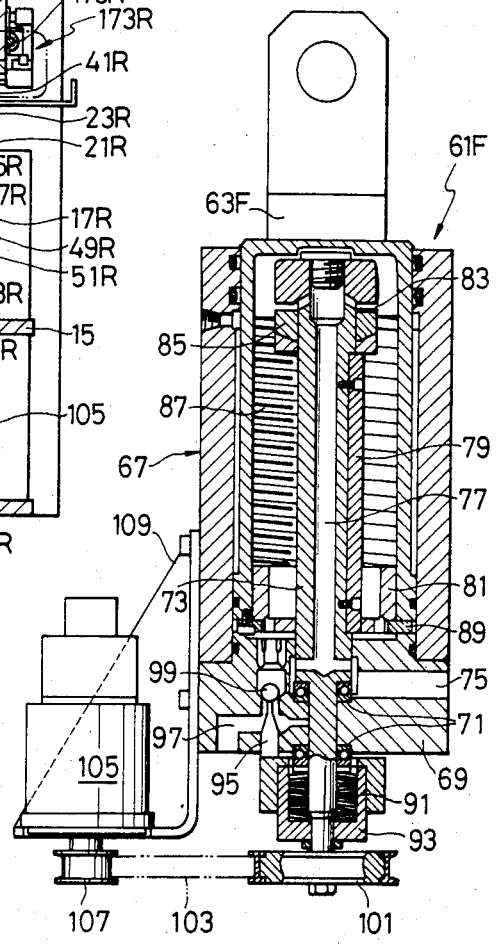
FIG. 3 is an enlarged sectional view taken along the line III—III in FIG. 1.

The bases of the bending cylinders 61F and 61R are pivotally attached to a plurality of brackets 65F and 65R which are secured to the base 5. These bending cylinders 61F and 61R are constructed so that they freely vary position proportional to the stroke of the piston rods 63F and 63R. Specifically, as is shown clearly in FIG. 3, a cylinder cap 69 is integrally mounted on one end of the cylinder body 67 of the bending cylinders 61F and 61R, and at the shaft center of this cylinder cap 69, a rotating rod 73 is removably and rotatingly supported by a plurality of bearings 71. The inner end section of the rotating rod 73 extends close to the other end of the cylinder body 67, and, a communication hole 77, which communicates with a port 75 formed in the cylinder cap 69, is pierced at the center section of the shaft. A guide key 79 is integrally mounted on the rotating rod 73, and mates with a cuff-nut member 81 in a freely slideable manner. In addition, a spherical washer 85, which can freely throttle the aperture 83 of the communication hole 77 which communicates with the cylinder body 67, is mated in a freely slideable manner with the inner end section of the rotating rod 73.

The nut member 81 is screwed into a female screw section 87, which is formed in the inner circumferential surfaces of the cylindrically formed piston rods 63F and 63R. The nut member 81 is prevented from coming out of the female screw section 87 by a stopper ring 89, which is secured on the inner ends of the piston rods 63F and 63R. A spring casing 93, into which is fitted a spring 91, such as an initially coned disc spring, is installed on the outside of the end section of the rotating rod 73, and a needle 95 is integrally mounted on that spring casing 93. This needle 95 is formed to press a ball-shaped check valve 99 which is positioned inside a drain port 97 formed in the cylinder cap 69. In addition, a pulley 101 is mounted on the outside end section of the rotating rod 73. A belt 103 runs between this pulley 101 and a pulley 107 mounted on the output shaft of a motor 105, such as a pulse motor or a servo motor. This motor 105 is supported by a bracket 109 on the cylinder body 67.

From this configuration, the rotating rod 73 is driven by the motor 105, causing it to rotate, upon which the nut member 81 is rotated against the piston rods 63F and 63R, and moves along with the female screw section 87. Accordingly, after the nut member 81 is suitably positioned, the piston rods 63F and 63R are caused to protrude by feeding pressurized oil from the port 75.

By means of the protruding action of the piston rods 63F and 63R, the nut member 81 comes into contact with the spherical washer 85, upon which the spherical washer 85 moves in the direction of the shaft. The aperture 83 is throttled so that the protruding action of the piston rods 63F and 63R is reduced in speed. Subsequently, when the piston rods 63F and 63R next protrude they encounter resistance by the spring 91, and the rotating rod 73 moves in the direction of the shaft. The needle 95 presses against the check valve 99 and because one part of the oil pressure in the cylinder 67 is discharged, the protruding action of the piston rods 63F and 63R is halted.

As has already been explained, the strokes of the piston rods 63F and 63R in the bending cylinders 61F and 61R can be optionally adjusted by adjusting the position of the nut member 81 under the control of the motor 105. Therefore the amount of rotation of the eccentric shafts 53F and 53R can be adjusted. Specifically, by adjusting the amount of rotation of the eccentric shafts 53F and 53R the amount of elevation of the bend-beams 47F and 47R can be adjusted, and the bending angle of the edge section of the workpiece W can be adjusted.

Figure 4:
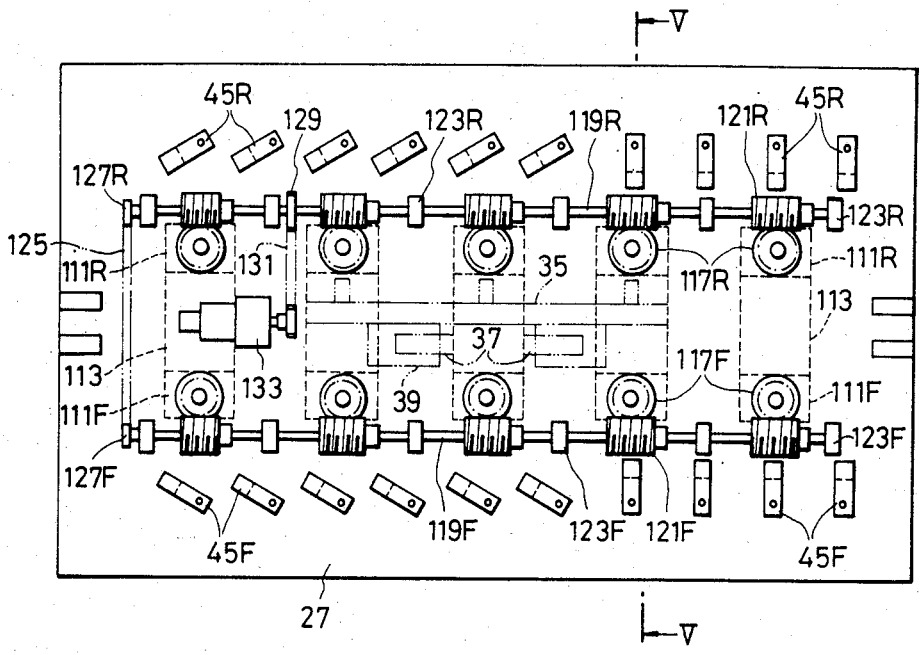
FIG. 4 is an enlarged sectional view taken along the line IV—IV in FIG. 1.
Figure 5:
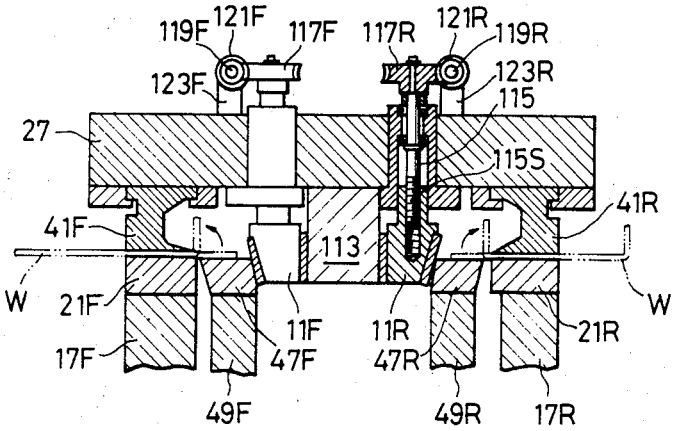
FIG. 5 is a sectional view taken along the line V—V in FIG. 4, and shows only the important parts corresponding to FIG. 2.

Now referring to FIGS. 2, 4 and 5, when the edge of the workpiece W is bent by the bend-beams 47F and 47R, the wedge-shaped guide members 111F and 111R, by which the bend-beams 47F and 47R are steered in the direction of the top dies 41F and 41R, are mounted in a position on the lower surface of the ram 27 which is freely adjustable vertically. More specifically, a plurality of guide section 113, which are separated in suitable spacing in the left and right direction, are mounted vertically in the central section of the front and rear direction of the ram 27. The wedge-shaped guide members 111F and 111R are moved to contact the front and back surface of these guide sections 113. Each of the wedge-shaped guide members 111F and 111R is formed as a slanting surface, in a position opposite the bend-beams 47F and 47R, slanting to the upper side approaching the side of the top dies 41F and 41R. Accordingly, when the bending-beams 47F and 47R are elevated to bend the end of the workpiece W by the action of the bending cylinders 61F and 61R, the bend-beams 47F and 47R are steered toward the top dies 41F and 41R by the wedge-shaped guide members 111F and 111R, and the edge of the workpiece W is bent.

As has already been explained, when the edge of the workpiece W, which is secured by being pressed against the bottom dies 21F and 21R by the top dies 41F and 41R, is bent by the bend-beams 47f and 47R, the force exerted on the bend-beams 47F and 47R is received by the guide section 113 of the ram 27. Accordingly, a companion force is transmitted to the top dies 41F and 41R through the ram 27 so that the force exerted to the top dies 41F and 41R, and the bend-beams 47F and 47R are balanced, and precision in the bending process is easily obtained.

Referring again to FIGS. 2, 4 and 5, a screw section 115S formed on the lower end of each of a plurality of adjustment frames 115, supported in a freely rotatable manner on the ram 27, is screwed into each of the respective guide members 111F and 111R. Also, a plurality of work gears 117F and 117R is fixed on the respective upper ends of each adjustment frame 115. A plurality of worms 121F and 121R, to which the rotating shafts 119F and 119R are fixed, engage the worm gears 117F and 117R. Each of the rotating shafts 119F and 119R is supported horizontally in a freely rotatable manner on the upper surface of the ram 27 by a plurality of bearing blocks 123F and 123R. A plurality of pulleys 127F and 127R is mounted on the ends of the rotating shafts 119F and 119R, and each of the pulleys 127F and 127R is fitted with a chain or belt 125R interconnectively linking the rotating shafts 119F and 119R. In addition, one of the rotating shafts 121R, is interconnectively linked to a motor 133 mounted on the ram 27, by the pulley 129 and the belt 131. Further, each of the wedge-shaped guide members 111F and 111R is formed so that they interlock with one another, and simultaneously move the same amount in the vertical direction.

As has already been made clear, it is possible to adjust the vertical position of each wedge-shaped guide member 111F and 111R, simultaneously and in the same amount, by the drive action of the motor 13. The amount of steering in the direction of the top dies 41F and 41R can be adjusted to correspond to the thickness of the workpiece W, over the complete range of thicknesses.

In this embodiment of the workpiece W between the bottom die 21F and the top die 41F, the bending machine 1 bends the edge of one side of the workpiece W (the right-hand edge in FIG. 2). Subsequently, the ram 27 is elevated and the workpiece W is released. The workpiece W moves in the right hand direction in FIG. 2, and after the workpiece W is secured between the bottom die 21R and the top die 41R, the other edge of the workpiece W (the left-hand edge in FIG. 2) is bent. A plurality of positioning devices 135 are provided for positioning both edges of the workpiece W as outlined above. A specific drawing is omitted, however, but the above positioning devices 135 are positioned with a suitable spacing between the bend-beam 47F or 47R. A stopper 137 on the positioning device 135, which is for positioning the edge of the workpiece W, moves in the right and left directions in FIG. 2, and, as well as being provided in a freely positionable manner, it does not cause interference when the workpiece W is passing, while causing an impasse on the pass-line of the workpiece W for positioning when the workpiece is processed.

The length of the top dies 41F and 41R is intended to be variable to comply with the width of the workpiece W, and these top dies 41F and 41R are supported so as to move freely in the left and right direction of the ram 27. Also, a rack device 139 is installed on one side of frame 7 to provide a plurality of storage sections where the top dies 41F and 41R can be freely stored.

Figure 6:
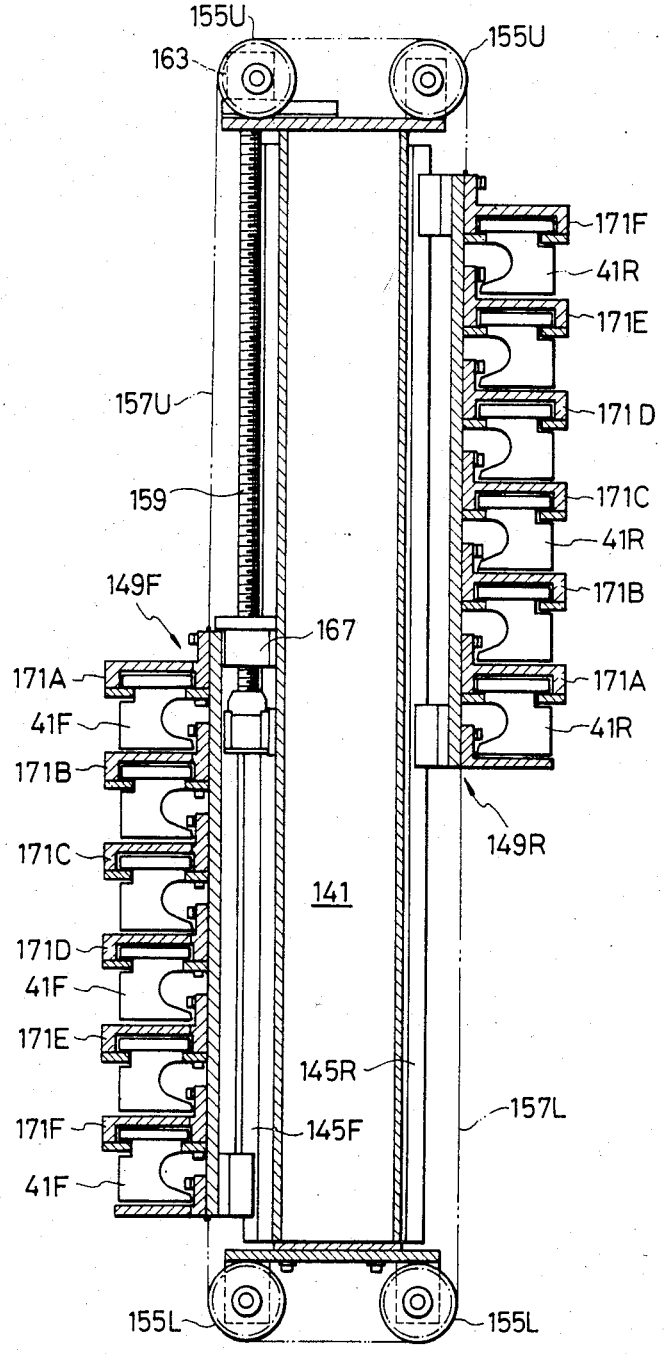
FIG. 6 is an enlarged sectional view taken along the line VI—VI in FIG. 1.
Figure 7:
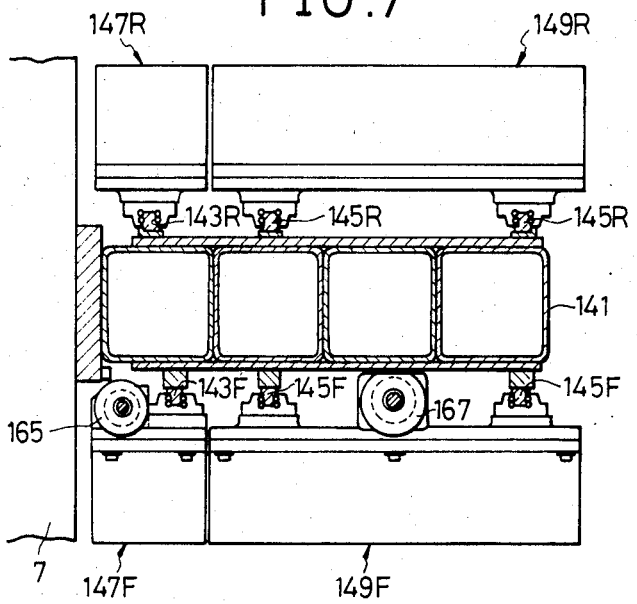
FIG. 7 is an enlarged sectional view taken along the line VII—VII in FIG. 1.

As is made clear in FIGS. 1, 6, and 7, a plurality of guide rails 143F and 143R, and 145F and 145R, are perpendicularly mounted on the front and back surfaces of a perpendicularly mounted support frame 141 on the outside surface of the frame 7. A plurality of first elevating racks 147F and 147R are supported in a freely elevatable manner on the guide rails 143F and 143R. Also, a plurality of second elevating racks 149F and 149R, which are positioned adjacent to the first elevating racks 147F and 147R, are supported in a freely elevatable manner on the guide rails 145F and 145R. Each of the first elevating racks 147F and 147R are connected by a plurality of vertical ropes or chains 153U and 153L running between a plurality of pulleys or sprockets 151U and 151L, which are installed in a freely rotatable manner on the upper and lower sections of the support frame 141. In addition, each of the second elevating racks 149F and 149R, are, in the same manner, connected by a plurality of vertical ropes or chains 157U and 157L running between a plurality of pulleys or sprockets 155U and 155L, which are installed in a freely rotatable manner on the upper and lower sections of the support frame 141.

Accordingly, the first elevating racks 147F and 147R and the second elevating racks 149F and 149R are respectively linked and move vertically. For example, when the front elevating racks 147F and 149F are elevated, the back elevating racks 147R and 149R are made to descend.

In order to move the first elevating racks, 147F and 147R, and the second elevating racks, 149F and 149R, individually in the vertical direction, a first elevating screw frame 157 and a second elevating screw frame 159 are supported in a freely rotatable manner on the support frame 141. These first and second elevating screw frames 157 and 159 are interconnectively linked to a plurality of first and second control motors 161 and 163 mounted on the support frame 141. In addition, a plurality of nut members 165 and 167 are screwed to the first and second elevating racks 147F and 149F. Accordingly, the first elevating racks 147F and 147R and the second elevating racks 149F and 149R can be individually elevated by the individual action of each control motor 161 and 163.

A plurality of stages of storage sections **169*a* to 169*f*, and 171A to 171F are respectively provided in each of the first and second elevating racks 147F and 147R, 149F and 149R, to support the storage of a suitable number of the top dies 41F and 41R. On each storage section 169*a* to 169*f* in the front first elevating rack 147F, a variety of lengths of top dies 41F are stored in order from the bottom stage while the equivalent top dies 41R in the rear first elevating rack 147R are stored in order from the bottom stage. In the same way, on each storage section 171A to 171F in the front second elevating rack 149F, a variety of lengths of top dies 41F are stored in order from the bottom stage, and on each storage section 171A to 171F in the rear second elevating rack 149R the equivalent top dies 41R** are stored in order from the bottom stage.

Accordingly, the length of the top die 41F should be variable to comply with the width of the workpiece W, and in both the first elevating rack 147F and the second elevating rack 149F, when the assembly of each storage section **169*a* to 169*f* and 171A to 171F is chosen optionally, the assembly of both the storage sections 169*a* to 169*f* of the first elevating rack 147R, and the storage sections 169A to 169F of the second elevating rack 149R, is the same for the rear as the front side. Therefore, the top dies 41F and 41R** for both front and rear can be changed simultaneously.

A plurality of die exchange systems 173F and 173R are provided on the front and back surfaces, respectively, of the ram 27 to simultaneously change the front and rear top dies 41F and 41R which are supported on the front and rear sections of the ram 27. More specifically, a plurality of guide rails 175 extend along the front and rear surfaces of the ram 27. The die exchange systems 173F and 173R are supported on these respective guide rails 175F in a freely movable manner. A plurality of pulleys 177F and 179F, and 177R and 179R (not shown on the drawings) are supported in a freely rotatable manner on the back and rear surfaces of the ram 27 in order to move the die exchange systems 173F and 173R along the guide rails 175F and 175R in the left and right directions. A plurality of belts 181F and 181R, such as timing belts, are fitted betwen the pulleys 177F and 179F, and 177R and 179R, respectively, and the respective die changing system 173F and 173R are connected to the belts 181F and 181R. The pulleys 179F and 179R are integrally mounted on the through shaft 183 which penetrates the ram 27 in the front and rear direction. The through shaft 183 is interconnectively linked with a control motor 187, such as a servomotor or pulse motor, installed on the ram 27 through a bracket 185.

Figure 8:
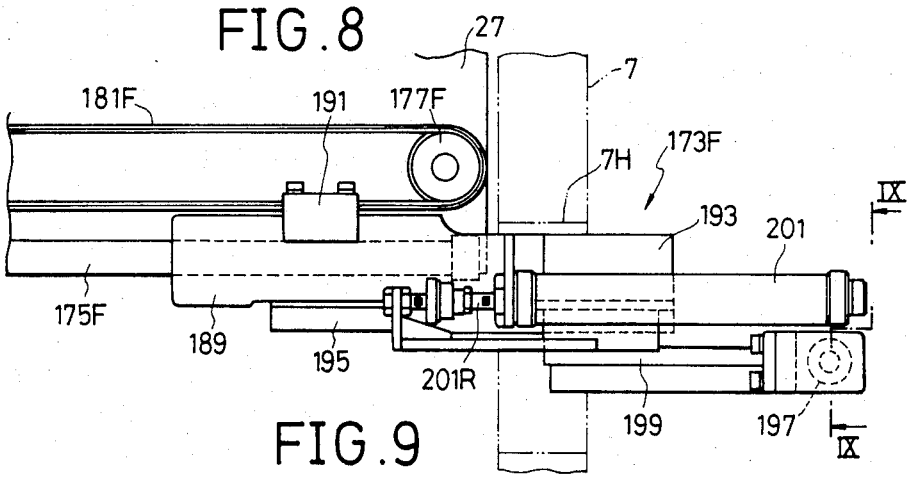
FIG. 8 is an enlarged drawing of the part indicated by the arrow VIII in FIG. 2.

Through this configuration, when the control motor 187 rotates, the front and rear die changing systems 173F and 173R move along the guide rails 175F and 175R simultaneously in the left and right direction. Now referring to FIG. 8 and FIG. 9, the movable block 189, which is freely movable in the left and right direction along the guide rail 175F in the die changing system 173F, is connected to the belt 181F using a suitable connecting tool 191. A nose section 193 which can penetrate the through-hole 7H which pierces the frame 7 and protrudes through the side of the rack device 139 is formed in the movable block 189. A guide rail 195, parallel to the direction of movement of the movable block 189, is formed on this nose section 193. A slide member 199, which supports a mini-cylinder 197 on its leading section, is supported in a freely movable manner on the guide rail 195. This slide member 199 is connected to a piston rod 201R of a retractable cylinder 201 supported on the movable block 189. Accordingly, by a suitable action of the retractable cylinder 201, the slide member 199 carries out a reciprocal action in opposition to the block 189.

Figure 9:
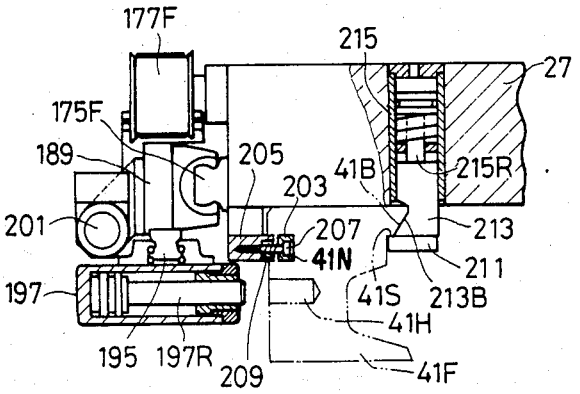
FIG. 9 is a sectional view taken along the line IX—IX in FIG. 8.

As shown in FIG. 9, the mini-cylinder 197 is adjacent a corresponding hole 41H formed in the front side surface of each top die 41F and provides a detachable piston rod 197R. A rectangular cutout section 41N elongated in the left and right direction is formed in the front surface of the top die 41F. The top die 41F is supported by engagement of the cutout section 41N with a support bar 203. The support bar 203 is elongated in the long direction of the ram 27, and is supported on a supporting member 205 secured to the lower surface of the ram 27 by a plurality of bolts 207 and a spring 209, such as a coil spring. A stage 41S is formed on the rear surface of the top die 41F, along with a slanting section 41B. The stage 41S of the top die 41F is supported on a support bar 211 provided on the ram 27 in parallel with the support bar 203. A slanting section 41B makes contact with a slanting section 213B which is formed on a clamp member 213 which is provided with free vertical movement at an appropriate number of locations on the ram 27. This clamp member 213 is connected to a piston rod 215R in a cylinder 215 mounted on the ram 27.

The clamping force employed on the slanting member 41B of the top die 41F is applied in the left direction in FIG. 9. When the edge of the workpiece W is being bent, the direction in which the pressure is applied is in the same direction thereby when the bending process is taking place, the securing of the top die is not loosened, and it allows the clamping force on the top die 41F to be low.

In this configuration, the top die 41F is made to move integrally with the movement of the movable block 189 in the status where the piston rod 197R in the mini-cylinder 197, corresponds to the corresponding hole 41H in the top die 41F, and the changing of the top die 41 is carried out. At this time, by the action of the retractable cylinder 201 and the positioning of the movable block 189 at a suitable distance from the rack device 139, the top die 41F can be moved toward the ram 27.

As can be understood from the above explanation, by means of the present invention, when the edge of the workpiece, which is held in a fixed position by the pressure of the top die against the bottom die, is bent by the bend-beams, the force used by the bend-beams is received from the ram and transmitted to the top dies, so that the forces are balanced and highly precise processing is obtained.

In addition, the adjustment of the clearance between the bend-beams and the top dies to correspond to the plate thickness of the workpiece can be easily performed. The adjustment of the bending angle of the workpiece is also easy. Furthermore, the securing of the workpiece by pressure is carried out uniformly, and the precision of the bending process is improved.

The process of bending both edges of the workpiece is also improved. An additional result is that bending both edges of the workpiece is also improved.

Furthermore, it becomes easy to select the length of the front and rear section of the top die to match the width of the workpiece, and, at the same time, both sides of the top die can be changed simultaneously, giving improved operating efficiency.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A die changing system in combination with a bending machine having front and rear bending stations, each station comprising a top die cooperable with a bottom die for gripping a workpiece and a bending beam movable to bend said workpiece against said top die, each bending beam having a bending surface for contacting and bending said workpiece, said bending surface extending horizontally along a longitudinal axis of the bending beam comprising:

a front plurality and a rear plurality of elevating racks supported for vertical movement adjacent said bending machine, each of said elevating racks being formed with a plurality of stages which store top dies separately;

means connected with said elevating racks for controlling the elevating racks individually to select any combination of top dies stored on the stages; and a die exchanging device supported on the bending machine for moving said top dies horizontally and furnishing the combination of the top dies in the proper position in the bending machine to both said front and rear bending stations by transferring said top dies from the stages.

2. The die changing system of claim 1, wherein said elevating racks are provided with a pair of sets of stages on which the top dies are arranged symmetrically with respect to the vertical direction.

3. A die changing system in combination with a bending machine having a frame, front and rear bottom dies supported in said frame, a ram mounted for vertical movement in said frame toward and away from the front and rear bottom dies, front and rear top dies replaceably mounted on said ram, and means for vertically moving said ram toward and away from said front and rear bottom dies to clamp workpieces between said front and rear top dies and said front and rear bottom dies, said front and rear dies forming separate bending stations with each station having a bending beam cooperating with the top and bottom dies to bend said workpiece against said top die, each bending beam having a bending surface for contacting and bending a workpiece, said bending surface extending horizontally along a longitudinal axis of the bending beam comprising:

means mounted on said frame adjacent said bending machine for storing a plurality of front and rear top dies;

means connected with said storing means for selecting any of said front and rear top dies; and means mounted on said ram for horizontally transferring said selected front and rear top dies between said storage means and the front and rear of said ram.

4. The die changing system of claim 3 in which the means for storing the front and rear top dies comprises a support frame fixed to a side of the bending machine frame, a plurality of vertically extending rails fixed to the front of the support frame, a pluralitY of vertically extending rails fixed to the rear of the support frame, and a plurality of stages slidingly mounted for vertical movement on the rails, wherein each of said stages supports a top die.

5. The die changing system of claim 4 wherein the means for selecting any of the front and rear top dies comprises an elevating screw frame vertically disposed in said support frame, a plurality of nuts threaded on said elevating screw frame, each of said nuts being connected with one of said stages, first and second pulleys mounted on either end of said suport frame, a rope trained over said pulley and interconnecting said stages, and a motor connected with said elevating screw frame whereby said stages may be selectively positioned in the vertical direction.

6. The die changing system of claim 3 wherein said means for storing the front and rear top dies comprises: a first set of elevating racks, said first set having one elevating rack disposed on the front side of the bending machine frame and one elevating rack disposed on the rear side of the bending machine frame; and a second set of elevating racks, said second set having one elevating rack disposed on the front side of the bending machine frame and one elevating rack disposed on the rear side of the bending machine frame.

7. The die changing system of claim 3 wherein the means for transferring the selected top dies between the storage means and the ram comprises a horizontally extending guide rail mounted on the ram, a movable block mounted on said guide rail for horizontal movement on the ram, said moveable block having a nose section extending laterally from the moveable block in the direction of the storage means, a first retractable cylinder mounted on the nose section for lateral extension toward and away from the storage means, a second retractable cylinder mounted on said first retractable cylinder for selective engagement with a selected top die, and means for driving the horizontal block on the rail.

* * * * *